US012601039B2

(12) United States Patent
Tsuboi et al.

(10) Patent No.: US 12,601,039 B2
(45) Date of Patent: Apr. 14, 2026

(54) FERRITIC STAINLESS STEEL AND METHOD FOR PRODUCING SAME

(71) Applicant: NIPPON STEEL Stainless Steel Corporation, Tokyo (JP)

(72) Inventors: Kohichi Tsuboi, Tokyo (JP); Kazunari Imakawa, Tokyo (JP); Shinichi Teraoka, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 407 days.

(21) Appl. No.: 18/287,114

(22) PCT Filed: Aug. 24, 2022

(86) PCT No.: PCT/JP2022/031950

§ 371 (c)(1),
(2) Date: Oct. 16, 2023

(87) PCT Pub. No.: WO2023/027129

PCT Pub. Date: Mar. 2, 2023

(65) Prior Publication Data

US 2024/0200177 A1 Jun. 20, 2024

(30) Foreign Application Priority Data

Aug. 24, 2021 (JP) ..... 2021-136345

(51) Int. Cl.
*C21D 8/02* (2026.01)
*C21D 8/0221* (2026.01)
(Continued)

(52) U.S. Cl.
CPC ..... *C22C 38/24* (2013.01); *C21D 8/0226* (2013.01); *C21D 8/0236* (2013.01);
(Continued)

(58) Field of Classification Search
None
See application file for complete search history.

(56) References Cited

FOREIGN PATENT DOCUMENTS

JP 2002-212679 A 7/2002
JP 2005-82838 A 3/2005
(Continued)

OTHER PUBLICATIONS

"Stainless Steel Handbook," Japan Stainless Steel Association ed., 3rd edition, 1995, p. 829 (4 pages total).

*Primary Examiner* — Anthony M Liang
(74) *Attorney, Agent, or Firm* — Birch, Stewart, Kolasch & Birch, LLP

(57) ABSTRACT

The present invention has an object to provide a ferritic stainless steel having a broad range of suitable quenching temperature and a high hardness and excellent corrosion resistance after quenching and beautiful and useful as a material for martensitic stainless steel products and provide an industrially stable method for production. The ferritic stainless steel of the present invention is characterized by having a steel composition comprising, by mass %, C: 0.45% or more and 0.55% or less, Si: 0.10% or more and 1.00% or less, Mn: 0.1% or more and 1.0% or less, Cr: 12.0% or more and 15.0% or less, Ni: 0% or more and 1.0% or less, Mo: 0.50% or more and 0.80% or less, V: 0.10% or more and 0.20% or less, N: 0.015% or more and 0.100% or less, P: 0% or more and 0.040% or less, S: 0% or more and 0.030% or less, balance: Fe and impurities, having an average crystal grain size of a ferrite phase of 10 μm or less, and having carbides having a diameter of 1.5 μm or less of $0.8/\mu m^2$ or more.

12 Claims, 1 Drawing Sheet

(51) Int. Cl.

| | |
|---|---|
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.

CPC ..... *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/22* (2013.01); *C21D 2211/005* (2013.01)

(56) References Cited

FOREIGN PATENT DOCUMENTS

| | | | |
|---|---|---|---|
| JP | 2007-224405 | A | 9/2007 |
| JP | 2021-50386 | A | 4/2021 |
| KR | 10-2013-0000841 | A | 1/2013 |
| KR | 10-2014-0080916 | A | 7/2014 |

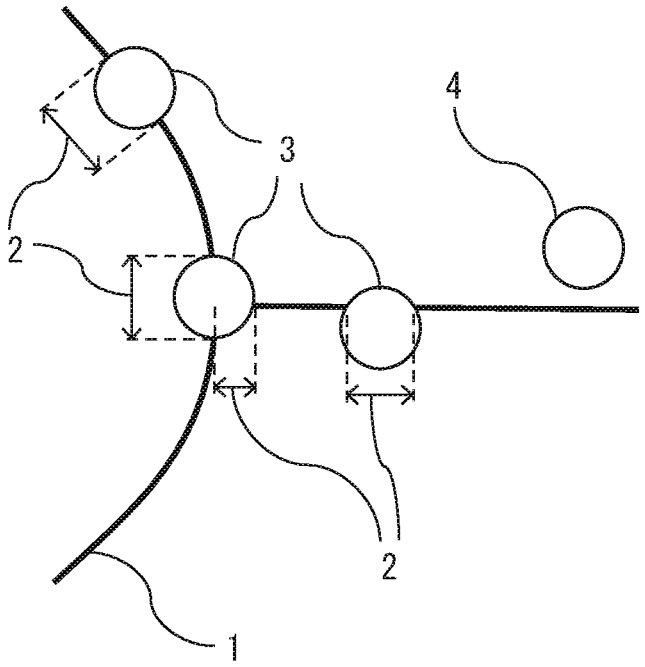
4
3
2
2
1

FERRITIC STAINLESS STEEL AND METHOD FOR PRODUCING SAME

FIELD

The present invention relates to ferritic stainless steel. In particular, it discloses ferritic stainless steel suitable as an intermediate of a martensitic stainless steel product suitable for a razor, kitchen knife, or other cutlery.

BACKGROUND

In applications such as blades of razors, kitchen knives, and other cutlery from which high hardness and corrosion resistance are sought, martensitic stainless steel containing carbon such as SUS420J1, SUS420J2, and EN1.4116 (NPL 1) is being used. These are also steels described in JIS G43034 or G43035. For general use cutlery, SUS420J1 and SUS420J2 in which 0.40% or less of C is contained are being used. On the other hand, for high quality cutlery from which further higher hardness and excellent corrosion resistance are demanded, EN1.4116 with a large Cr content and further with V and Mo added to improve the corrosion resistance is used.

Stainless steel transforms to a hard martensite phase in which carbon supersaturated at room temperature is dissolved by water cooling or oil cooling or other rapid cooling from the state of a high temperature austenite phase in which a relatively high concentration of carbon can be dissolved. That is, it becomes martensitic stainless steel. The hardness of this martensite phase corresponds to the amount of dissolved C of the austenite phase at the time of high temperature heating. It is known that the suitable range of quenching temperature for obtaining the target hardness is affected by the size of the carbides before quenching.

Further, the carbides present before and after quenching are mainly comprised of Cr, are believed to contain V and Mo as well aimed at the improvement of the corrosion resistance, and have a great effect on the corrosion resistance. That is, if coarse carbides are present, the corrosion resistance deteriorates in their vicinity.

On the other hand, stainless steel breaks down into a soft ferrite phase and carbides if relatively gently cooling it from the state of a high temperature austenite phase or if heating and holding it in the state of a low temperature ferrite phase compared with the state of an austenite phase since the C dissolved in the matrix phase precipitates.

Therefore, at the time of production of general martensitic stainless steel products, the steel is soft at the stage of production of the intermediate used as the material. In the state of ferritic stainless steel, which is generally excellent in workability, sheets, rods, wires, and other shapes are produced, then the shapes are worked into products or, simultaneously with or after working, are quenched to martensitic stainless steel.

The present invention is predicated on application to high quality cutlery made of martensitic stainless steel from which particularly high hardness and excellent corrosion resistance are demanded and covers ferritic stainless steel to which 0.45% or more of C is added as an intermediate used for its production. Note that, application is not limited to high quality cutlery. The steel can also be applied to other applications requiring excellent characteristics and involving working. Further, in high quality cutlery, preferably the products have beautiful surfaces. "Beautiful" means excellent in surface shape and having the excellent surface properties of being excellent in corrosion resistance and not rusting for a longer time than the past or even in a harsh corrosive environment.

In the process of production of the intermediate ferritic stainless steel, the general practice is to hot work an ingot obtained by continuous casting or ingot casting, cool the steel once down to room temperature, and further reheat it break it down into the ferrite phase and carbides to soften the steel (NPL 2).

For this reheating, for the above breakdown, usually a long time period of several hours is necessary. The carbides dispersed in the ferrite phase easily become coarse. If quenching the ferritic stainless steel intermediate in which coarse carbides are dispersed, the steel often becomes softer than the target hardness.

Further, if the carbides present before and after quenching contain the Cr, Mo, and V required for obtaining excellent corrosion resistance, often the corrosion resistance will deteriorate around the carbides.

To obtain excellent characteristics by dissolution of the elements, it is necessary to make the quenching temperature and time higher and longer, make the coarse carbides dissolve (redissolve), and secure predetermined dissolved amounts. If coarse carbides are present, there was the technical problem that the characteristics would deteriorate after quenching and would not be stable.

As means for solving this technical problem, for example, PTL 1 discloses the technique of rendering the amounts of C and N added suitable ones and limiting the number density of carbides in the ferritic stainless steel intermediate before quenching. Due to this, the suitable range of quenching temperature giving the target characteristics becomes broader and the required characteristics can be stably secured after quenching.

CITATIONS LIST

Patent Literature

[PTL 1] Japanese Unexamined Patent Publication No. 2007-224405

Nonpatent Literature

[NPL 1] Stainless Steel European Standard EN10088-2
[NPL 2] Stainless Steel Handbook, 3rd Edition, Japan Stainless Steel Association ed. (1995), p. 829

SUMMARY

Technical Problem

In the material obtained by heat treating the ferritic stainless steel intermediate material of PTL 1, thick parts Cr depletion partially occur due to oxidation at the time of heating and, when working the material into cutlery products, sometimes uneven spots appear and the surface appearance of the cutlery products are damaged.

The present invention has as its technical problem the provision of ferritic stainless steel provided with a broad suitable range of quenching temperature and a high hardness and excellent corrosion resistance after quenching and useful as a material for beautiful, martensitic stainless steel products and the provision of an industrially stable method for production.

Solution to Problem

The inventors investigated in detail the metallographic structure of ferritic stainless steel to which 0.45% or more of C is added and suitable as an intermediate of cutlery use martensitic stainless steel products having high hardness and excellent corrosion resistance and clarified the quenching conditions giving a predetermined hardness, corrosion resistance, and beautiful surface.

As a result, they clarified that the uneven spots appearing on the surface of cutlery products causing deterioration of the corrosion resistance and impairing the beauty occur due to parts Cr depletion right under the oxides containing Cr caused by grain boundary oxidation etc. Further, they discovered that by making the crystal grain size finer and increasing the grain boundary density in the material, the carbides on the grain boundaries dissolve early whereby outward diffusion of Cr, Mo, and V is promoted and parts Cr depletion at the surface and near the coarse carbides can be eliminated early.

Furthermore, they discovered that by making the average crystal grain size finer and controlling the distribution of carbides, the suitable range of quenching temperature in which high hardness and excellent corrosion resistance and beautiful surface appearance are stably obtained expands.

The inventors clarified the characteristics of the steel composition and metallographic structure where such an effect is obtained and thereby completed the present invention. The gist of the present invention is as follows:

(1) A ferritic stainless steel having a steel composition comprising, by mass %, C: 0.45% or more and 0.55% or less, Si: 0.10% or more and 1.00% or less, Mn: 0.1% or more and 1.0% or less, Cr: 12.0% or more and 15.0% or less, Ni: 0% or more and 1.0% or less, Mo: 0.50% or more and 0.80% or less, V: 0.10% or more and 0.20% or less, N: 0.015% or more and 0.100% or less, P: 0% or more and 0.040% or less, S: 0% or more and 0.030% or less, and balance: Fe and impurities, having an average crystal grain size of a ferrite phase of 10 μm or less, and having carbides having a diameter of 1.5 μm or less of 0.8/$\mu m^2$ or more.

(2) The ferritic stainless steel of (1), wherein an occupancy ratio of 1.5 μm or less the carbides of 1.5 μm or less in a ferrite grain boundary length is 5.0% or more.

(3) The ferritic stainless steel of (1) or (2), comprising, instead of part of the Fe, by mass %, one or more of Al: 0.30% or less, Nb: 0.070% or less, B: 0.0030% or less, Ti: 0.070% or less, Sn: 0.12% or less, Cu: 0.40% or less, W: 1.000% or less, Co: 0.500% or less, Zr: 0.500% or less, Ca: 0.0050% or less, Mg: 0.0050% or less, Y: 0.1000% or less, REM: 0.10% or less, and Sb: 0.15% or less.

(4) A ferritic stainless steel sheet having a thickness of 0.4 to 6.0 mm, and having the features according to any of (1) to (3).

(5) A method for producing the ferritic stainless steel of any one of (1) to (3), the method for producing the ferritic stainless steel comprising the steps of hot rolling a steel having a composition according to (1) or (3) by a start temperature of 1150° C. or more and a finish temperature of 850° C. to 900° C. to obtain a hot rolled steel sheet, then cooling the hot rolled steel sheet by a cooling rate of 0.07° C./s or more up to a temperature of 700° C. to 800° C., and, after cooling, heating and holding the hot rolled steel sheet at a temperature of 700° C. to 800° C. for 20 minutes or more and 20 hours or less.

(6) A method for producing the ferritic stainless steel sheet of (4), the method for producing the ferritic stainless steel sheet comprising the steps of hot rolling a steel having a composition according to (1) or (3) by a start temperature of 1150° C. or more and a finish temperature of 850° C. to 900° C. to obtain a hot rolled steel sheet, then cooling the hot rolled steel sheet by a cooling rate of 0.07° C./s or more up to a temperature of 700° C. to 800° C., after cooling, heating and holding the hot rolled steel sheet at a temperature of 700° C. to 800° C. for 20 minutes or more and 20 hours or less, pickling the hot rolled steel sheet after heating and holding, cold rolling the pickled hot rolled steel sheet to obtain a cold rolled steel sheet, and heat treating the cold rolled steel sheet at a temperature of 700° C. to 800° C.

Advantageous Effects of Invention

According to the present invention, it is possible to provide beautiful ferritic stainless steel with a broad suitable range of quenching temperature and with a high hardness and excellent corrosion resistance.

BRIEF DESCRIPTION OF DRAWINGS

FIG. 1 is a view schematically showing criteria for judging a carbide is a "carbide on a grain boundary" and a "line segment length at a grain boundary".

DESCRIPTION OF EMBODIMENTS

1. Ferritic Stainless Steel

Below; the ferritic stainless steel of the present invention will be explained in detail.

(Chemical Constituents)

First, the constituents contained in the ferritic stainless steel of the present invention will be explained. Note that, the "%" of the contents of the elements mean mass %.

C is an important element for securing the hardness of martensite. Further it acts also as an element generating Cr carbides and having an effect on the corrosion resistance of the matrix phase. If the C content is less than 0.45%, the quenched hardness required in cutlery applications cannot be obtained. Further, the number density of carbides of 1.5 μm or less contributing to stable quenching hardness becomes insufficient, so the suitable range of quenching temperature also becomes narrower. Further, the carbides do not effectively act for pinning and the average crystal grain size of the ferrite phase in heating in a furnace after hot rolling becomes coarser. On the other hand, if the C content exceeds 0.55%, the carbides becomes coarser, the number density becomes insufficient, and the suitable range of quenching temperature becomes narrower. Further, the necessary corrosion resistance cannot be satisfied. For this reason, the C content is made 0.45% or more and 0.55% or less. The lower limit of the C content is preferably 0.46%, more preferably 0.47%. The upper limit of the C content is preferably 0.54%, more preferably 0.53%.

Si is an element improving the oxidation resistance. If the Si content is less than 0.10%, sufficient oxidation resistance cannot be obtained. Further, if excessively reducing it, an increase in the production costs is invited. On the other hand, if the Si content exceeds 1.00%, fracture at the time of production is exacerbated. For this reason, the Si content is made 0.10% or more and 1.00% or less. The lower limit of the Si content is preferably 0.20%, more preferably 0.30%. The upper limit of the Si content is preferably 0.90%, more preferably 0.80%.

Mn is used as a deoxidizing element. Further, it is believed that due to the interaction with C, the amount of dissolved C increases and this contributes to improvement of the hardness after quenching. From the viewpoint of stable manufacturability and the manifestation of the effect of increase in dissolved C due to the interaction with C, the Mn content is made 0.1% or more. On the other hand, if the Mn content exceeds 1.0%, sulfides and other compounds are liable to be formed and invite a drop in corrosion resistance. Further, it is believed that the effect of the increase in dissolved C due to the interaction with C becomes saturated and an effect commensurate with the amount added cannot be obtained. For this reason, the Mn content is made 0.1% or more and 1.0% or less. The lower limit of the Mn content is preferably 0.2%, more preferably 0.3%. The upper limit of the Mn content is preferably 0.9%, more preferably 0.8%.

Cr is an element improving the corrosion resistance. Further, Cr is an element improving the hardenability and an element keeping down the drop in hardness after diffusion transformation and quenching. Furthermore, it is also an element forming carbides and has an effect on the carbide density in the metallographic structure before quenching. If the Cr content is less than 12.0%, a sufficient corrosion resistance, effect of suppression of diffusion transformation, and carbide density are not obtained. On the other hand, if the Cr content is more than 15.0%, a drop in the manufacturability is invited. Further, a corrosion resistance commensurate with the cost of the added alloy cannot be obtained. Further, the amount of residual γ formed due to the drop in the quenching transformation temperature (Ms point) becomes large and a drop in the hardness is invited. For this reason, the Cr content is made 12.0% or more and 15.0% or less. The lower limit of the Cr content is preferably 12.5%, more preferably 13.0%, still more preferably 14.0%. Furthermore, the lower limit of the Cr content may also be 14.1% or may be 14.3%. The upper limit of the Cr content is preferably 14.9%, more preferably 14.7%.

Ni is an element improving the toughness when making the steel a martensite phase and may be added according to need. However, if the Ni content exceeds 1.0%, a drop in the formability is invited. Further, it is a rare element and expensive. It is liable to lead to a rise in alloy costs and impairment of manufacturability. For this reason, the Ni content is made 1.0% or less. Preferably it is 0.60% or less, more preferably 0.05% or more and 0.50% or less. If containing Ni, its content may be a trace amount, but the lower limit is preferably 0.05%, more preferably 0.10%. The upper limit of the Ni content is preferably 0.60%, more preferably 0.50%.

Mo is an element improving the corrosion resistance. Further, it is also an element improving the hardness by solution strengthening. If the Mo content is less than 0.50%, a sufficient effect of improvement of the corrosion resistance and hardness by solution strengthening cannot be obtained. On the other hand, even if adding an Mo content in more than 0.80%, the effect on the corrosion resistance and the solution strengthening becomes saturated and an effect commensurate with the cost of addition cannot be obtained. For this reason, the Mo content is made 0.50% or more and 0.80% or less. The lower limit of the Mo content is preferably 0.55%, more preferably 0.60%. The upper limit of the Mo content is preferably 0.75%, more preferably 0.70%.

V is an element improving the corrosion resistance. It also acts as an element causing fine precipitation of carbides and raises the number density of carbides. If the V content is less than 0.10%, a sufficient corrosion resistance cannot be obtained. Further, the effect of raising the number density of carbides cannot be sufficiently obtained. On the other hand, even if adding the V content in more than 0.20%, the effect on the corrosion resistance and the effect of raising the number density of carbides become saturated and effects commensurate with the cost of addition cannot be obtained. For this reason, the V content is made 0.10% or more and 0.20% or less. The lower limit of the V content is preferably 0.11%, more preferably 0.13%. The upper limit of the V content is preferably 0.19%, more preferably 0.17%.

N is an element for securing the hardness of martensite in the same way as C. If the N content is less than 0.015%, a sufficient hardness cannot be secured. On the other hand, if the N content exceeds 0.100%, the hot workability remarkably deteriorates. For this reason, the N content is made 0.015% or more and 0.100% or less. The lower limit of the N content is preferably 0.020%, more preferably 0.030%, still more preferably 0.040%. The upper limit of the N content is preferably 0.090%, more preferably 0.080%.

P is an element lowering the formability and corrosion resistance. Its content is preferably low. For this reason, the P content is made 0.040% or less. The lower limit is not particularly prescribed.

S is an unavoidable impurity element. Fracture at the time of production is exacerbated. For this reason, the S content is made 0.030% or less. The lower limit is not particularly prescribed. The ferritic stainless steel of the present invention is comprised of Fe and impurities (including unavoidable impurities) in addition to the above-mentioned elements.

The ferritic stainless steel of the present disclosure may selectively contain, in addition to the above basic composition, instead of part of the Fe, by mass %, one or two or more of Al: 0.30% or less, Nb: 0.070% or less, B: 0.0030% or less, Ti: 0.070% or less, Sn: 0.12% or less, Cu: 0.40% or less, W: 1.000% or less, Co: 0.500% or less, Zr: 0.500% or less, Ca: 0.0050% or less, Mg: 0.0050% or less, Y: 0.1000% or less, REM: 0.10% or less, and Sb: 0.15% or less.

(Al: 0.30% or Less, Nb: 0.070% or Less, B: 0.0030% or Less, Ti: 0.070% or Less)

The elements of Al, Nb, B, and Ti need not be added. If these elements are added, there are the effects of improvement of the formability of the ferritic stainless steel and suppression of defects at the time of hot working. When added, the Al content is made 0.30% or less, the Nb content is made 0.070% or less, the B content is made 0.0030% or less, and the Ti content is made 0.070% or less. To reliably obtain the effects, preferably the Al, Nb, and Ti contents are made 0.01% or more and the B content is made 0.001% or more.

(Sn: 0.12% or Less, Cu: 0.40% or Less, W: 1.000% or Less, Co: 0.500% or Less, Zr: 0.500% or Less)

The elements of Sn, Cu, W, Co, and Zr need not be added. If these elements are added, there is the effect of improvement of the corrosion resistance. When added, the Sn content is made 0.12% or less, the Cu content is made 0.40% or less, the W content is made 1.000% or less, the Co content is made 0.500% or less, and the Zr content is made 0.500% or less. To reliably obtain the effect, preferably the Sn, Cu, Co, and Zr contents are made 0.01% or more and the W content is made 0.1% or more.

(Ca: 0.0050% or Less, Mg: 0.0050% or Less, Y: 0.1000% or Less, Hf: 0.20% or Less, REM: 0.10% or Less, Sb: 0.15% or Less)

The elements of Ca, Mg, Y, REM, and Sb need not be added. These elements have the effect of changing the oxides, sulfides, and other inclusions and suppressing hot working defects. When added, the Ca content is made 0.0050% or less, the Mg content is made 0.0050% or less, the Y content is made 0.1000% or less, the Hf content is made 0.20% or less, the REM content is made 0.10% or less, and the Sb content is made 0.15% or less. To reliably obtain the effects, preferably the Ca and Mg contents are made 0.0001% or more and the Y, Hf, and REM contents are made 0.01% or more.

Note that, in this application, "REM" indicates elements belonging to atomic numbers 57 to 71 (lanthanoids). For example, it indicates La, Ce, Pr, Nd, etc. Y is not included.

The ferritic stainless steel of the present disclosure may also contain, in addition to the above-mentioned elements and, furthermore, in place of part of the Fe, elements other than the elements explained above in a range enabling the above technical problem to be solved. For example, Bi, Pb, Se, H, Ta, etc. may be contained, but the ratios of contents are controlled to an extent able to solve the above technical problem. For example, one or more of Bi≤100 ppm, Pb≤100 ppm, Se≤100 ppm, H≤100 ppm, and Ta≤500 ppm may be contained.

(Average Crystal Grain Size of Ferrite Phase and State of Precipitation of Carbides)

In the ferritic stainless steel of the present invention, the average crystal grain size of the ferrite phase is made finer and the size and number density of the carbides are prescribed so as to secure excellent characteristics including a beautiful surface.

By making the average crystal grain size finer, the carbides positioned on the grain boundaries of the ferrite phase increase. At the time of high temperature heating, the carbides on the grain boundaries act as nuclei for transformation to the austenite phase and the grain boundary area of the austenite phase is made to increase. For this reason, the carbides proceed to redissolve, outward diffusion of the redissolved Cr, M, and V is promoted, and the Cr deficiency can be quickly resolved. In addition to the above provision, if the ratio (occupancy) of carbides in the lengths of the grain boundaries of the ferrite phase is a certain value or more, the effect of resolving the Cr deficiency becomes further higher and the corrosion resistance is remarkably improved.

The average crystal grain size of the ferrite phase has to be 10 μm or less. The average crystal grain size is preferably 9 μm or less, more preferably 8 μm or less. On the other hand, the lower limit of the average crystal grain size is not particularly limited, but is made 1 μm or more from experience. On the other hand, if the average crystal grain size is more than 10 μm, the carbides present on the grain boundaries decrease, the phenomenon of the parts of Cr depletion being resolved does not occur, and excellent characteristics cannot be secured.

(Method of Measuring Average Crystal Grain Size of Ferrite Phase)

The average crystal grain size of the ferrite phase is identified as follows. The L-section of the steel sheet prepared as a sample by electrolytic polishing is measured by EBSD. The measurement region is made 300 μm×300 μm at the position of sheet thickness $\sqrt{1/4}$t. The size of the measurement steps is made 0.1 μm. If the misorientation of the adjoining plot data is less than 15°, the data is deemed the same crystal. If the misorientation is 15° or more, the data is treated as different crystal grains and the average crystal grain size is sought. Note that, if the measurement region contains phases other than the ferrite phase, only the ferrite phase is extracted, then the average crystal grain size is found.

The greater the number density of the carbides at sizes able to be redissolved in the austenite phase at the time of high temperature heating, the better. Regarding the size of the carbides, coarse carbides with a diameter of more than 1.5 μm must not be contained. Preferably, the diameter is 1.0 μm or less.

Further, the number density of carbides has to be 0.8/μm$^2$ or more of carbides of a diameter of 1.5 μm or less. Preferably, it is 1.0/μm$^2$ or more, more preferably 1.2 μm$^2$ or more. The upper limit of the number density is not particularly prescribed. Note that, if the size and number density of the carbides satisfy the above conditions, the amount of dissolved C required for the target hardness can be sufficiently secured, so the suitable range of quenching temperature also expands.

To secure a beautiful surface appearance after quenching and remarkably improve the corrosion resistance, the occupancy of carbides of a diameter of 1.5 μm or less at the grain boundaries is preferably 5.0% or more. The occupancy is preferably 7.0% or more, more preferably 10.0% or more. The upper limit is not prescribed, but is preferably 17.0% or less.

(Methods of Measurement of Size and Number Density of Carbides and Occupancy of Carbides at Grain Boundaries)

The size and number density of the carbides are specified by the following methods.

The L-section of the steel sheet is polished to a mirror finish, then is etched by aqua regia to bring out the grain boundaries and carbides. An SEM is used to examine the sheet and measure the size and number density of the carbides. The measurement region is made a total area of 200 μm×200 μm at a sheet thickness $\sqrt{1/4}$ position. The examination power is made 5000× for the SEM examination. The size of the carbides is found by conversion of the examined carbides to the equivalent circle diameter. The number density of carbides [/μm$^2$] is calculated as the area of the measurement region with respect to the number of carbides of a diameter of 1.5 μm or less confirmed in the measurement region.

The "occupancy" (P [%]) in the present invention is defined as the ratio of carbides of a diameter of 1.5 μm or less at the grain boundaries. The occupancy is found as the ratio of the sum (b [μm]) of the line segment lengths of the carbides present at the grain boundaries to the total grain boundary lengths (a [μm]) in the measurement region. Formula (2) shows the calculation formula. Further, FIG. 1 schematically shows criteria for judging "carbides on a grain boundary" and a "line segment length in a grain boundary".

$$P=b/a\times 100 \quad (1)$$

Note that, the carbides confirmed in the ferritic stainless steel of the present invention are mostly $(Cr,Fe)_{23}C_6$, but some $(Cr,Fe)_7C_3$ may also be contained. The carbides can be confirmed by EDX.

(Presence of Other Phases Besides Ferrite Phases and Carbides)

The metallographic structure of the ferritic stainless steel of the present invention is comprised of a ferrite phase and just a very small ratio of a large number of fine carbides at room temperature. However, to some extent, the presence of the other phases can be allowed. For example, there is no problem even if the ferritic stainless steel of the present invention contains phases other than the main phase of the ferrite phase at room temperature, for example, the austenite phase or martensite phase, in an area ratio of a total of 5% or less.

(Method of Judging Presence of Austenite Phase and Martensite Phase)

The presence of the austenite phase is judged using the data measured by the EBSD described in the previous paragraphs. The austenite phase has an FCC structure while the ferrite phase has a BCC structure, so the austenite phase is judged by finding the ratio (Y[%]) of the FCC structures in the measurement region. If the value found by formula (1) is 5% or less, it is judged that there is no austenite phase. Here, γ is the area ratio of the austenite phase (unit: [%]), and F and B show the number of plots of the FCC structure and BCC structure obtained when measuring them by EBSD (unit: [no.]).

$$\gamma=F/(F+B)\times 100 \quad (2)$$

The presence of the martensite phase is judged by the Vickers hardness. If the martensite phase is present in 5% or more, the hardness exceeds 300 HV. A Vickers hardness meter is used to measure the hardness by a load of 500 g 10 times. If the average value of the same is 300 HV or less, it is judged that there is no martensite phase.

(Sheet Thickness)

The sheet thickness after hot rolling is 4.0 mm or more and 6.0 mm or less. The sheet thickness at the cold rolling stage after that is 0.4 mm or more and less than 4.0 mm. The sheet thickness of the ferritic stainless steel of the present invention covers 0.4 mm or more and 6 mm or less from hot rolling to the cold rolling stage, including the product thickness.

2. Method for Producing Ferritic Stainless Steel (Method of Production)

The method of production of the ferritic stainless steel of the present invention will be explained next.

Steel comprised of the above-mentioned composition is smelted and cast to produce an ingot which is then heated. If the heating temperature (start temperature of hot rolling explained later) is less than 1150° C., the carbides cannot be made to sufficiently dissolve, the characteristics fluctuate depending on the portion, and coarse carbides remain so the suitable range of quenching temperature of the products becomes narrower. For this reason, the heating temperature is made 1150° C. or more. Preferably it is 1180° C. or more.

Next, the heat ingot is hot rolled. If the finish temperature of the hot rolling is less than 850° C., the deformation load becomes too high, so the load on the equipment performing the hot rolling becomes higher and the steel cannot be worked to a predetermined shape. On the other hand, if more than 950° C., coarse carbides remain without being crushed and the suitable range of quenching temperature of the products becomes narrower. Therefore, the finish temperature of the hot rolling is made 850° C. or more and 950° C. or less. Preferably it is made 860° C. or more and 940° C. or less.

Right after the hot rolling ends, the cooling rate is controlled to cool the steel until of temperature of the later step of heating and holding of 700° C. or more and 800° C. or less. At this time, the cooling rate has to be made 0.07° C./s or more and the heat history has to be managed so that the temperature is not lowered to less than 700° C. in the middle of cooling. The cooling rate is preferably 0.20° C./s or more. The work strain built up due to the hot rolling is maintained until right before the heating and holding whereby, after the heating and holding, the average crystal grain size of the ferrite phase becomes 10 μm or less. On the other hand, if the cooling rate is slower than 0.07° C./s, the work strain is recovered from during cooling and the nuclei for formation of the ferrite phase decrease, so the ferrite becomes coarser during heating and holding.

In the conventional method for producing a ferritic stainless steel intermediate, in the case of a general production process, that is, a heat history of controlling the cooling rate after the hot rolling while cooling the steel down to room temperature once and raising the temperature again and heating and holding the steel, the crystal grains of the ferrite phase become coarser in the process of the strain in the martensite phase disappearing. As opposed to this, in the method for producing the ferritic stainless steel of the present invention, it is extremely important to control the cooling rate and temperature history from right after hot rolling to right before heating and holding. In the conventional method for producing a ferritic stainless steel intermediate, such control of the cooling rate and temperature history is not performed.

After cooling down to a temperature of heating and holding of 700° C. or more and 800° C. or less, next heating and holding is performed. If the temperature of the heating and holding is less than 700° C., the number density of carbides of 1.5 μm or less becomes remarkably lower, ferrite transformation does not sufficiently proceed, and, when heating and holding the steel and then cooling it down to room temperature, the metallographic structure becomes one with a large hard martensite phase. As a result, transfer to the cold rolling and other later steps becomes difficult and the production costs increase and the yield falls. On the other hand, if more than 800° C., the carbides aggregate and coarsen and the suitable range of quenching temperature becomes narrower. Further, the average crystal grain size of the ferrite phase also becomes coarser.

The time period of the heating and holding is made 20 minutes or more and 20 hours or less. If the time period of the heating and holding is less than 20 minutes, the number density of carbides with a diameter of 1.5 μm or less remarkably falls. After cooling down to room temperature, a large amount of the martensite phase is contained in the metallographic structure. As a result, transfer to the cold rolling and other later steps becomes difficult and the production costs increase and the yield falls. On the other hand, if heating and holding for more than 20 hours, the carbides aggregate and coarsen and the suitable range of quenching temperature become narrower. Further, the crystal grains of the ferrite phase also become coarser. Therefore, heating and holding is performed by holding the steel at 700° C. or more and 800° C. or less temperature for 20 minutes or more and 20 hours or less. Preferably, it is performed at 710° C. or more and 790° C. or less temperature for 75 minutes or more and 15 hours or less.

The cooling rate after heating and holding is not particularly limited. For example, the cooling rate may be 0.05° C./s or more. The cooling may also be air-cooled.

After heating and holding and cooling are completed, in accordance with need, the steel can be pickled, cold rolled, and finally heat treated repeatedly to obtain steel sheet of a predetermined sheet thickness.

Pickling is a step for removing the oxide scale of the surface, the cold rolling is a step for obtaining a predetermined sheet thickness, and the final heat treatment is a step of releasing the strain introduced by the cold rolling and softening the steel by recrystallization. In the production of the stainless steel, there is no problem with the general method.

If the temperature of the final heat treatment is less than 700° C., the recrystallization is insufficient and the steel becomes hard. Transfer to the next step or working at the customer side becomes difficult. On the other hand, if a higher temperature than 800° C., the steel reaches a temperature region where the austenite phase becomes stable and the result after cooling becomes a metallographic structure containing a large martensite phase whereby the steel becomes hard and transfer to the next step or working at the customer side becomes difficult. For this reason, the temperature of the final heat treatment is made 700° C. or more and 800° C. or less. Preferably it is 710° C. or more and 790° C. or less.

EXAMPLES

Examples will be shown while explaining the effects of the ferritic stainless steel of the present invention.

Steels having the compositions shown in Table 1 were smelted in a laboratory to obtain thickness 100 mm ingots. The ingots were heated at the temperatures of Table 2 for 120 minutes, then hot rolled to obtain thickness 5.0 mm hot rolled sheets.

After this, the hot rolled sheets were cooled down to the heating and holding temperatures shown in Table 2 by cooling rates of 0.05 to 2.00° C./s in range. After reaching the heating and holding temperatures, the sheets were heated and holed for the time periods shown in Table 2. After the heating and holding, the sheets were air cooled to cool them down to room temperature. The Nos. 1 to 16 and 18 to 34 steel sheets were pickled by sulfuric acid, cold rolled by a rolling reduction of 60%, and further heat treated at 700 to 800° C.×2 minutes to obtain thickness 2.0 mm steel sheets.

Further, the Nos. 1 to 15 and 18 to 34 steel sheets were cold rolled, then the cold rolled sheets were annealed and were again pickled to obtain thickness 0.8 mm steel sheets.

In this study, compared with the production process of the present invention, No. 33 cooled the steel once to room temperature after hot rolling, then again raised it in temperature to heat and hold it there.

TABLE 1

| Steel | Constituents (mass %): balance of Fe and impurities | | | | | | | | | | |
|---|---|---|---|---|---|---|---|---|---|---|---|
| type | C | Si | Mn | P | S | Cr | Ni | Mo | V | N | Others |
| A | 0.45 | 0.30 | 0.2 | 0.024 | 0.028 | 15.0 | 0.7 | 0.50 | 0.18 | 0.023 | |
| B | 0.48 | 0.90 | 0.1 | 0.014 | 0.026 | 14.3 | 0.5 | 0.55 | 0.13 | 0.052 | |
| C | 0.50 | 0.50 | 0.5 | 0.036 | 0.030 | 14.6 | 0.1 | 0.65 | 0.15 | 0.031 | |
| D | 0.53 | 0.60 | 1.0 | 0.038 | 0.025 | 14.1 | 0.2 | 0.75 | 0.20 | 0.018 | |
| E | 0.55 | 0.20 | 0.8 | 0.012 | 0.024 | 14.7 | 0.4 | 0.80 | 0.11 | 0.071 | Sn: 0.001, Co: 0.001 |
| F | 0.25 | 0.50 | 0.9 | 0.039 | 0.011 | 14.5 | 0.5 | 0.62 | 0.14 | 0.088 | Ti: 0.005, Nb: 0.005 |
| G | 0.85 | 0.80 | 0.3 | 0.051 | 0.021 | 11.5 | 0.1 | 0.55 | 0.18 | 0.035 | Zr: 0.005, W: 0.005 |
| H | 0.49 | 0.51 | 0.5 | 0.022 | 0.025 | 14.5 | 0.1 | 0.60 | 0.12 | 0.020 | Al: 0.05, Co: 0.2 |
| I | 0.45 | 0.30 | 0.2 | 0.024 | 0.028 | 15.0 | 0.7 | 0.50 | 0.18 | 0.039 | Sn: 0.09, B: 0.0005 |
| J | 0.48 | 0.90 | 0.1 | 0.014 | 0.026 | 14.3 | 0.5 | 0.55 | 0.13 | 0.071 | B: 0.0030, Cu: 0.07 |
| K | 0.50 | 0.50 | 0.5 | 0.036 | 0.030 | 14.6 | 0.1 | 0.65 | 0.15 | 0.096 | Ca: 0.0030, Mg: 0.0002 |
| L | 0.53 | 0.60 | 1.0 | 0.039 | 0.025 | 14.1 | 0.2 | 0.75 | 0.20 | 0.055 | La: 0.0002, Ce: 0.0002 |
| M | 0.55 | 0.20 | 0.8 | 0.012 | 0.024 | 14.7 | 0.4 | 0.80 | 0.11 | 0.062 | Y: 0.0002, Sb: 0.01 |
| N | 0.49 | 0.51 | 0.5 | 0.022 | 0.025 | 14.5 | 0.1 | 0.60 | 0.12 | 0.020 | Zr: 0.100 |
| O | 0.49 | 0.51 | 0.5 | 0.022 | 0.025 | 14.5 | 0.1 | 0.60 | 0.12 | 0.020 | Nb: 0.050 |
| P | 0.49 | 0.51 | 0.5 | 0.022 | 0.025 | 14.5 | 0.1 | 0.60 | 0.12 | 0.020 | Ti: 0.050 |

TABLE 2

| | | | Production conditions | | | | | | | | Metallic structure Average |
|---|---|---|---|---|---|---|---|---|---|---|---|
| | | | | Hot | Cooling after hot rolling | | | | Final | | crystal grain |
| | | | Ingot heating | rolling End | Cooling | Room temp. | Heating and holding | | heat treat. | Sheet | size of ferrite |
| Class | No. | Steel type | Temp. ° C. | temp. ° C. | speed ° C./s | cooling Yes/No | Temp. ° C. | Time Min. | Temp. ° C. | thick. mm | phase μm |
| Inv. | 1 | C | 1250 | 875 | 0.15 | No | 750 | 120 | 750 | 0.8 | 9.5 |
| ex. | 2 | A | 1250 | 875 | 0.25 | No | 780 | 100 | 750 | 0.8 | 5.4 |
| | 3 | A | 1270 | 850 | 0.30 | No | 800 | 1180 | 760 | 0.8 | 8.0 |
| | 4 | B | 1300 | 880 | 0.50 | No | 760 | 60 | 780 | 0.8 | 9.5 |
| | 5 | B | 1190 | 870 | 0.20 | No | 780 | 25 | 720 | 0.8 | 7.6 |
| | 6 | C | 1270 | 860 | 0.80 | No | 740 | 1000 | 720 | 0.8 | 8.0 |
| | 7 | C | 1230 | 870 | 1.20 | No | 750 | 600 | 740 | 0.8 | 9.5 |
| | 8 | C | 1210 | 850 | 2.00 | No | 720 | 200 | 760 | 0.8 | 7.5 |
| | 9 | C | 1190 | 860 | 1.50 | No | 770 | 300 | 780 | 0.8 | 9.8 |
| | 10 | C | 1170 | 900 | 1.20 | No | 700 | 800 | 800 | 0.8 | 6.5 |
| | 11 | C | 1150 | 850 | 0.25 | No | 720 | 150 | 710 | 0.8 | 8.5 |
| | 12 | D | 1200 | 900 | 0.60 | No | 710 | 500 | 730 | 0.8 | 9.2 |
| | 13 | D | 1170 | 890 | 0.80 | No | 700 | 30 | 750 | 0.8 | 8.7 |
| | 14 | E | 1230 | 860 | 1.80 | No | 750 | 130 | 770 | 0.8 | 8.5 |
| | 15 | E | 1160 | 860 | 1.30 | No | 760 | 1150 | 790 | 0.8 | 8.7 |
| | 16 | C | 1250 | 875 | 0.50 | No | 750 | 120 | 750 | 2.0 | 9.6 |
| | 17 | C | 1250 | 875 | 0.60 | No | 750 | 130 | — | 5.0 | 9.3 |
| | 18 | H | 1250 | 875 | 0.50 | No | 780 | 100 | 750 | 0.8 | 4.9 |
| | 19 | I | 1250 | 875 | 0.50 | No | 780 | 100 | 750 | 0.8 | 5.4 |
| | 20 | J | 1300 | 880 | 0.50 | No | 760 | 60 | 780 | 0.8 | 9.5 |
| | 21 | K | 1270 | 860 | 0.80 | No | 740 | 1000 | 720 | 0.8 | 8.0 |
| | 22 | L | 1200 | 900 | 0.60 | No | 710 | 500 | 730 | 0.8 | 9.2 |

TABLE 2-continued

| | | | | | | | | | | | |
|---|---|---|---|---|---|---|---|---|---|---|---|
| | 23 | M | 1230 | 860 | 1.80 | No | 750 | 130 | 770 | 0.8 | 8.5 |
| | 24 | N | 1250 | 875 | 0.50 | No | 780 | 100 | 750 | 0.8 | 5.3 |
| | 25 | O | 1250 | 875 | 0.50 | No | 780 | 100 | 750 | 0.8 | 5.4 |
| | 26 | P | 1250 | 875 | 0.50 | No | 780 | 100 | 750 | 0.8 | 5.0 |
| Comp | 31 | F | 1200 | 800 | 0.35 | No | 740 | 200 | 760 | 0.8 | 12.5 |
| ex. | 32 | G | 1190 | 860 | 0.50 | No | 780 | 220 | 770 | 0.8 | 11.8 |
| | 33 | C | 1240 | 890 | 1.30 | Yes | 720 | 180 | 750 | 0.8 | 12.0 |
| | 34 | C | 1250 | 875 | 0.05 | No | 750 | 150 | 770 | 0.8 | 12.5 |

| | | | Metallic structure | | Material characteristics | | | | |
|---|---|---|---|---|---|---|---|---|---|
| | | | No. density of carbides (dia. 1.5 μm or less) | Occupancy of carbides at grain boundaries (dia. 1.5 μm or less) | Quenching hardness stability (⊿T) | Defect rate | Corrosion resistance Pass/Fail | | Overall |
| | Class | No. | No./μm$^2$ | % | ° C. | % | 4 h | 24 h | eval. |
| | Inv. | 1 | 1.5 | 4.2 | 50 | 4.5 | Pass | Fail | Good |
| | ex. | 2 | 1.4 | 5.2 | 40 | 3.2 | Pass | Pass | Very good |
| | | 3 | 1.1 | 5.3 | 30 | 2.5 | Pass | Pass | Very good |
| | | 4 | 2.0 | 5.5 | 40 | 3.8 | Pass | Pass | Very good |
| | | 5 | 2.2 | 6.0 | 30 | 4.1 | Pass | Pass | Very good |
| | | 6 | 1.2 | 5.0 | 30 | 2.9 | Pass | Pass | Very good |
| | | 7 | 1.1 | 5.5 | 50 | 1.9 | Pass | Pass | Very good |
| | | 8 | 2.1 | 6.1 | 30 | 2.2 | Pass | Pass | Very good |
| | | 9 | 2.6 | 5.8 | 40 | 3.6 | Pass | Pass | Very good |
| | | 10 | 1.9 | 5.4 | 30 | 1.8 | Pass | Pass | Very good |
| | | 11 | 2.1 | 5.1 | 50 | 2.1 | Pass | Pass | Very good |
| | | 12 | 2.2 | 5.3 | 30 | 4.8 | Pass | Pass | Very good |
| | | 13 | 2.7 | 6.6 | 40 | 3.5 | Pass | Pass | Very good |
| | | 14 | 3.0 | 5.6 | 30 | 4.1 | Pass | Pass | Very good |
| | | 15 | 2.8 | 6.0 | 30 | 3.7 | Pass | Pass | Very good |
| | | 16 | 1.2 | 5.6 | 40 | 2.5 | Pass | Pass | Very good |
| | | 17 | 1.3 | 5.1 | 40 | 2.8 | Pass | Pass | Very good |
| | | 18 | 1.8 | 5.2 | 40 | 3.2 | Pass | Pass | Very good |
| | | 19 | 1.4 | 5.2 | 40 | 3.2 | Pass | Pass | Very good |
| | | 20 | 2.0 | 5.5 | 40 | 3.8 | Pass | Pass | Very good |
| | | 21 | 1.2 | 5.0 | 30 | 2.9 | Pass | Pass | Very good |
| | | 22 | 2.2 | 5.3 | 30 | 4.8 | Pass | Pass | Very good |
| | | 23 | 3.0 | 5.6 | 30 | 4.1 | Pass | Pass | Very good |
| | | 24 | 1.4 | 5.3 | 30 | 3.1 | Pass | Pass | Very good |
| | | 25 | 1.2 | 5.0 | 40 | 3.3 | Pass | Pass | Very good |
| | | 26 | 1.8 | 5.1 | 30 | 3.2 | Pass | Pass | Very good |
| | Comp | 31 | 0.7 | 4.2 | 10 | 6.4 | Pass | Fail | Poor |
| | ex. | 32 | 0.7 | 3.5 | 10 | 5.3 | Fail | — | Poor |
| | | 33 | 1.1 | 3.1 | 40 | 5.9 | Pass | Fail | Poor |
| | | 34 | 1.2 | 4.1 | 30 | 6.2 | Pass | Fail | Poor |

Underlines show outside scope of claims.

The average crystal grain size of the ferrite phase, the presences of the austenite phase and martensite phase, the size and number density of the carbides, and the presence of the carbides at the grain boundaries were measured by the above-mentioned methods.

(Method of Measuring Cooling Rate After Hot Rolling)

The cooling rate after completion of hot rolling is defined as the average cooling rate from the completion of hot rolling to when reaching the temperature of the heating and holding. The history of temperature was measured using a radiant thermometer.

(Test for Evaluation of Quenched Hardness Stability)

Each test material shown in Table 2 was held at a heating temperature of 900 to 1150° C. for 5 minutes, then air-cooled. Further, the quenched hardness of the sample was investigated. Note that, the heating temperature was changed in 10° C. increments. The quenching stability (ΔT[° C.]) was evaluated by formula (3).

$$\Delta T = T\max - T\min \quad (3)$$

Tmin[° C.] and Tmax[° C.] respectively show the minimum temperature and maximum temperature giving a quenched hardness of 550 HV or more. The greater the ΔT, the broader the range of quenching temperature at which the quenched hardness or more is obtained and the better the quenched hardness stability. On the other hand, when ΔT is 0, it means the minimum temperature Tmin and maximum temperature Tmax match and the quenching stability being inferior. Here, an ΔT of 30° C. or more was evaluated as passing and one of less than 30° C. was evaluated as failing.

(Test for Evaluation of Surface Appearance)

Each test material shown in Table 2 was held at heating temperatures of Tmin and Tmax for 5 minutes, then air-cooled to obtain a quenched sample. Further, the oxide scale of the quenched sample was removed to expose the metal skin, then #600 wet polishing was used to finish the surface. Any uneven spots were checked for visually. If the ratio of the total area of the uneven spots in the total area 1 m$^2$ of the observed field (below and in Table 2, referred to as the "defect rate") is 5.0% or less at both the heating temperatures Tmin and Tmax, the sample is judged as passing and evaluated as satisfying the beautiful surface appearance required from high quality cutlery. In other cases, the sample is judged as failing. The defect rate in Table 2 is the larger of the defect rates at the heating temperatures Tmin and Tmax.

(Test for Evaluation of Corrosion Resistance)

A test piece prepared by quenching heat treatment and the polishing method similar to the test for evaluation of the surface appearance was used for a salt spray test at a test temperature of 50° C. with a 7% NaCl solution. Whether corrosion resistance passes or fails was judged by whether red rust could be observed on the surface of the test piece. If red rust could not be observed visually under the conditions of both the heating temperatures Tmin and Tmax after 4 hours from the start of test, the resistance was evaluated as passing and the corrosion resistance required as cutlery was judged as satisfactory. Other cases were evaluated as failing. So long as being judged as passing, the evaluation test was extended until the total of the test time became 24 hours. When red rust could not be observed visually under the conditions of both the heating temperatures Tmin and Tmax after the evaluation test, the corrosion resistance was judged as further better.

Table 2 shows the results of evaluation of the quenched hardness stability, defect rate, and corrosion resistance. In Nos. 1 to 26 with average crystal grain sizes of the ferrite phase and the number densities of carbides both the prescribed values or more, the suitable range of quenching temperature giving a high hardness and excellent corrosion resistance was broad and further a beautiful surface appearance was provided. In particular, in Examples 2 to 26 where the occupancies of carbides at the grain boundaries were the prescribed values or more, the corrosion resistances were remarkably improved.

On the other hand, in No. 31, the number density of carbides was small and the average crystal grain size of the ferrite phase was also coarse, so quenched hardness stability was insufficient and the defect rate was also poor.

In No. 32, the number density of carbides was small and the quenched hardness stability was insufficient. Further, the amount of Cr added was excessively small, so the corrosion resistance was insufficient. In No. 32, the amount of C added was excessive, so coarse carbides were excessively present and the quenched hardness stability was poor. Further, the amount of Cr added was excessively small, so the corrosion resistance was also poor.

In No. 33, with a heat history of being cooled once down to room temperature after hot rolling, then again being raised in temperature to be heated and holed there, the average crystal grain size was coarse and the defect rate of the surface appearance was higher than prescribed.

In No. 34 with a slow cooling rate after hot rolling, the average crystal grain size was coarse and the defect rate of the surface appearance was higher than prescribed.

INDUSTRIAL APPLICABILITY

The ferritic stainless steel of the present disclosure is provided with a broad suitable range of quenching temperature, a high hardness and excellent corrosion resistance after quenching, and a beautiful surface. That is, it is optimal as an intermediate for martensitic stainless steel and, as one example, enables efficient production of high quality cutlery products from which hardness, excellent corrosion resistance, and beauty are demanded.

REFERENCE SIGNS LIST

1. grain boundaries
2. line segment length in grain boundaries
3. carbides on grain boundaries
4. carbides not on grain boundaries

The invention claimed is:

1. A ferritic stainless steel
having a steel composition comprising, by mass %,
C: 0.45% or more and 0.55% or less,
Si: 0.10% or more and 1.00% or less,
Mn: 0.1% or more and 1.0% or less,
Cr: 12.0% or more and 15.0% or less,
Ni: 0% or more and 1.0% or less,
Mo: 0.50% or more and 0.80% or less,
V: 0.10% or more and 0.20% or less,
N: 0.015% or more and 0.100% or less,
P: 0% or more and 0.040% or less,
S: 0% or more and 0.030% or less, and
balance: Fe and impurities,
having an average crystal grain size of a ferrite phase of 10 μm or less, and
having carbides having a diameter of 1.5 μm or less of $0.8/\mu m^2$ or more.

2. The ferritic stainless steel according to claim 1, wherein an occupancy ratio of the carbides having a diameter of 1.5 μm or less in a ferrite grain boundary length is 5.0% or more.

3. The ferritic stainless steel according to claim 1, comprising,
instead of part of the Fe,
by mass %, one or more of
Al: 0.30% or less,
Nb: 0.070% or less,
B: 0.0030% or less,
Ti: 0.070% or less,
Sn: 0.12% or less,
Cu: 0.40% or less,
W: 1.000% or less,
Co: 0.500% or less,
Zr: 0.500% or less,
Ca: 0.0050% or less,
Mg: 0.0050% or less,
Y: 0.1000% or less,
REM: 0.10% or less, and
Sb: 0.15% or less.

4. A ferritic stainless steel sheet having a thickness of 0.4 to 6.0 mm, and having the features according to claim 1.

5. A method for producing the ferritic stainless steel according to claim 1,
the method for producing the ferritic stainless steel comprising the steps of:
hot rolling a steel having a composition comprising, by mass %,
C: 0.45% or more and 0.55% or less,
Si: 0.10% or more and 1.00% or less,
Mn: 0.1% or more and 1.0% or less,
Cr: 12.0% or more and 15.0% or less,
Ni: 0% or more and 1.0% or less,
Mo: 0.50% or more and 0.80% or less,
V: 0.10% or more and 0.20% or less,
N: 0.015% or more and 0.100% or less,
P: 0% or more and 0.040% or less,
S: 0% or more and 0.030% or less, and
balance: Fe and impurities,
by a start temperature of 1150° C. or more and a finish temperature of 850° C. to 900° C. to obtain a hot rolled steel sheet,
then cooling the hot rolled steel sheet by a cooling rate of 0.07° C./s or more up to a temperature of 700° C. to 800° C., and, after cooling, heating and holding the hot rolled steel sheet at a temperature of 700° C. to 800° C. for 20 minutes or more and 20 hours or less.

6. A method for producing the ferritic stainless steel sheet according to claim 4, the method for producing the ferritic stainless steel sheet comprising the steps of:

hot rolling a steel having a composition comprising, by mass %,

C: 0.45% or more and 0.55% or less,
Si: 0.10% or more and 1.00% or less,
Mn: 0.1% or more and 1.0% or less,
Cr: 12.0% or more and 15.0% or less,
Ni: 0% or more and 1.0% or less,
Mo: 0.50% or more and 0.80% or less,
V: 0.10% or more and 0.20% or less,
N: 0.015% or more and 0.100% or less,
P: 0% or more and 0.040% or less,
S: 0% or more and 0.030% or less, and
balance: Fe and impurities, by a start temperature of 1150° C. or more and a finish temperature of 850° C. to 900° C. to obtain a hot rolled steel sheet, then cooling the hot rolled steel sheet by a cooling rate of 0.07° C./s or more up to a temperature of 700° C. to 800° C., after cooling, heating and holding the hot rolled steel sheet at a temperature of 700° C. to 800° C. for 20 minutes or more and 20 hours or less, pickling the hot rolled steel sheet after heating and holding, cold rolling the pickled hot rolled steel sheet to obtain a cold rolled steel sheet, and heat treating the cold rolled steel sheet at a temperature of 700° C. to 800° C.

7. The ferritic stainless steel according to claim 2, comprising, instead of part of the Fe,
by mass %, one or more of
Al: 0.30% or less,
Nb: 0.070% or less,
B: 0.0030% or less,
Ti: 0.070% or less,
Sn: 0.12% or less,
Cu: 0.40% or less,
W: 1.000% or less,
Co: 0.500% or less,
Zr: 0.500% or less,
Ca: 0.0050% or less,
Mg: 0.0050% or less,
Y: 0.1000% or less,
REM: 0.10% or less, and
Sb: 0.15% or less.

8. A ferritic stainless steel sheet having a thickness of 0.4 to 6.0 mm, and having the features according to claim 2.

9. A ferritic stainless steel sheet having a thickness of 0.4 to 6.0 mm, and having the features according to claim 3.

10. A ferritic stainless steel sheet having a thickness of 0.4 to 6.0 mm, and having the features according to claim 7.

11. A method for producing the ferritic stainless steel according to claim 1, the method for producing the ferritic stainless steel comprising the steps of:

hot rolling a steel having a composition comprising, by mass %,

C: 0.45% or more and 0.55% or less,
Si: 0.10% or more and 1.00% or less,
Mn: 0.1% or more and 1.0% or less,
Cr: 12.0% or more and 15.0% or less,
Ni: 0% or more and 1.0% or less,
Mo: 0.50% or more and 0.80% or less,
V: 0.10% or more and 0.20% or less,
N: 0.015% or more and 0.100% or less,
P: 0% or more and 0.040% or less,
S: 0% or more and 0.030% or less, and
balance:
Fe,
by mass %, one or more of
Al: 0.30% or less,
Nb: 0.070% or less,
B: 0.0030% or less,
Ti: 0.070% or less,
Sn: 0.12% or less,
Cu: 0.40% or less,
W: 1.000% or less,
Co: 0.500% or less,
Zr: 0.500% or less,
Ca: 0.0050% or less,
Mg: 0.0050% or less,
Y: 0.1000% or less,
REM: 0.10% or less, and
Sb: 0.15% or less,
and impurities, by a start temperature of 1150° C. or more and a finish temperature of 850° C. to 900° C. to obtain a hot rolled steel sheet, then cooling the hot rolled steel sheet by a cooling rate of 0.07° C./s or more up to a temperature of 700° C. to 800° C., and, after cooling, heating and holding the hot rolled steel sheet at a temperature of 700° C. to 800° C. for 20 minutes or more and 20 hours or less.

12. A method for producing the ferritic stainless steel sheet according to claim 4, the method for producing the ferritic stainless steel sheet comprising the steps of:

hot rolling a steel having a composition comprising, by mass %,

C: 0.45% or more and 0.55% or less,
Si: 0.10% or more and 1.00% or less,
Mn: 0.1% or more and 1.0% or less,
Cr: 12.0% or more and 15.0% or less,
Ni: 0% or more and 1.0% or less,
Mo: 0.50% or more and 0.80% or less,
V: 0.10% or more and 0.20% or less,
N: 0.015% or more and 0.100% or less,
P: 0% or more and 0.040% or less,
S: 0% or more and 0.030% or less, and
balance:
Fe,
by mass %, one or more of
Al: 0.30% or less,
Nb: 0.070% or less,
B: 0.0030% or less,
Ti: 0.070% or less,
Sn: 0.12% or less,
Cu: 0.40% or less,
W: 1.000% or less,
Co: 0.500% or less,
Zr: 0.500% or less,
Ca: 0.0050% or less,
Mg: 0.0050% or less, Y: 0.1000% or less,
REM: 0.10% or less, and
Sb: 0.15% or less,
and impurities, by a start temperature of 1150° C. or more and a finish temperature of 850° C. to 900° C. to obtain a hot rolled steel sheet, then cooling the hot rolled steel sheet by a cooling rate of 0.07° C./s or more up to a temperature of 700° C. to 800° C., after cooling, heating and holding the hot rolled steel sheet at a temperature of 700° C. to 800° C. for 20 minutes or more and 20 hours or less, pickling the hot rolled steel sheet after heating and holding, cold rolling the pickled hot rolled steel sheet to obtain a cold rolled steel sheet, and heat treating the cold rolled steel sheet at a temperature of 700° C. to 800° C.

* * * * *